US005842617A

United States Patent [19]

Younkle et al.

[11] Patent Number: 5,842,617

[45] Date of Patent: Dec. 1, 1998

[54] FAST TAP APPARATUS FOR DISPENSING PRESSURIZED BEVERAGES

[76] Inventors: Matthew C. Younkle, 401 E. Ontario #2805, Chicago, Ill. 60611; Robert A. Meyers, 7413 Old Sauk Rd. Apt. #7, Madison, Wis. 53717; Kristofer M. Dressler, 1112 Mound St., Madison, Wis. 53715

[21] Appl. No.: 926,570

[22] Filed: Sep. 10, 1997

Related U.S. Application Data

[60] Provisional application No. 60/026,043 Sep. 13, 1996.

[51] Int. Cl.[6] ..... B65D 83/14; B05B 1/14

[52] U.S. Cl. ..... 222/400.7; 222/394; 239/590

[58] Field of Search ..... 239/590; 222/394, 222/400.7

[56] References Cited

U.S. PATENT DOCUMENTS

| | | | |
|---|---|---|---|
| 2,899,170 | 8/1959 | Cornelius . | |
| 3,233,631 | 2/1966 | Cornelius . | |
| 3,291,441 | 12/1966 | Hansen . | |
| 3,502,111 | 3/1970 | Hansen . | |
| 3,608,778 | 9/1971 | Paranto | 222/30 |
| 4,094,445 | 6/1978 | Bevan . | |
| 4,194,653 | 3/1980 | Brown . | |
| 4,493,443 | 1/1985 | Bailey . | |
| 4,655,374 | 4/1987 | Guerette . | |
| 4,901,887 | 2/1990 | Burton . | |
| 4,982,879 | 1/1991 | Corrado et al. | 222/400.7 |
| 5,033,645 | 7/1991 | Shannon et al. . | |
| 5,050,806 | 9/1991 | Anderson et al. . | |
| 5,050,995 | 9/1991 | Lucore, II | 366/136 |
| 5,058,632 | 10/1991 | Laware, Sr. et al. . | |
| 5,269,442 | 12/1993 | Vogel . | |
| 5,390,832 | 2/1995 | Lombardo . | |

*Primary Examiner*—Andres Kashnikow
*Assistant Examiner*—Keats Quinalty
*Attorney, Agent, or Firm*—DeWitt Ross & Stevens S.C.

[57] ABSTRACT

An apparatus for dispensing beverages including a fluid conduit terminating in a conduit exit, the conduit exit being oriented upwardly when the apparatus is in an operative position, and a dispenser head defining an enclosure surrounding the conduit exit, the dispenser head having a pouring aperture opening onto the enclosure. The pressure within the fluid conduit is regulated so that beverage traveling upwardly toward the conduit exit experiences a stagnation point, causing the beverage to pour from the pouring aperture of the enclosure due to gravity.

22 Claims, 4 Drawing Sheets

FAST TAP APPARATUS FOR DISPENSING PRESSURIZED BEVERAGES

CROSS-REFERENCE TO RELATED APPLICATIONS

This application claims priority under 35 USC §119(e) to U.S. Provisional Patent Application No. 60/026,043 filed Sep. 13, 1996, the entirety of which is incorporated by reference herein.

FIELD OF THE INVENTION

This disclosure generally concerns an apparatus for dispensing pressurized or carbonated beverages, and more specifically to an apparatus for dispensing pressurized or carbonated beverages at extremely high flow rates with minimal foaming.

BACKGROUND OF THE INVENTION

Many standards have developed in pressurized beverage dispensing systems, particularly in systems designed to dispense beer. One such standard is the beer storage vessel, called a keg. Kegs are reusable and refillable aluminum containers that allow for efficient, sanitary handling and dispensing of 15.5 gallons (58.7 liters) of beer. Kegs are completely sealed and air-tight except for one standard fitting located at the top of the keg which allows attachment of a device known as a tavern head. The tavern head mates tightly and securely with the standardized fitting on top of the keg and allows attachment of an outgoing beer line and a pressure source to the keg. Since the tavern head must conform to the standardized fitting on the keg, the basic design of the tavern head has also become an industry standard.

The beer within the keg is maintained under pressure in order to propel it to the desired dispensing location. In small-scale applications, pressure is typically provided via a hand-powered air pump, while larger applications typically use pressure regulated cylinders of carbon dioxide as the pressure source. In some situations nitrogen or other non-reactive gases may be used. Either copper or stainless steel piping or FDA approved beverage tubing is used to convey the beer from the tavern head to the location of dispensing. Means for controlling beer flow is most commonly a lever-actuated valve located a few inches from the point where the beer is dispensed.

It is the ultimate goal of any beer dispensing system to deliver cold beer at a desired flow rate with the beer leaving the faucet in a continuous, substantially liquid state—that is, the beer leaving the faucet should not contain excessive amounts of foam. Foaming occurs when the carbon dioxide dissolved in the beer suddenly precipitates out of the liquid beer. Drastic pressure changes, agitation, and changes in temperature all enhance the precipitation of gases and thus enhance foaming. Foam bubbles require a nucleation site to form, and thus particles in the beer or microscopic imperfections on the inside surface of the beer tap can also enhance foaming. Excess foam is possibly the leading limiter of beer pouring speed and the leading cause of wasted beer, and thus the major cause of lost profits for a proprietor.

At many taverns located near colleges and universities, the amount of beer consumed on any given weekend night is tremendous. Taverns can be filled to capacity with a line of patrons waiting at the bar to be served. Servers often cannot work fast enough to fulfill the demand and patrons become frustrated or leave due to poor service. One of the most time-consuming tasks for servers is holding a glass or a pitcher of beer at the tap and waiting for it to fill. Present conventional beer tapping systems obtain an optimal volumetric flow rate of approximately one U.S. gallon (3.786 liters) of beer per minute. It would be desirable for taverns to have a dispensing system capable of a higher volumetric flow rate, since the rate at which beer is dispensed is often the limiting factor in the amount of beer sold in a given evening. Having a faster dispensing system with the same or a reduced amount of foam allows a tavern to serve more beer faster and thus realize higher profits for the proprietor.

Current dispensing systems theoretically have the capability to increase volumetric flow rate by increasing the pressure of the propellant. Since flow rate is roughly proportional to pressure, doubling the propellant pressure should double the flow rate. However, increasing the propellant pressure poses several problems in practice. First, the change in pressure as the beer leaves the tap increases with increasing propellant pressure. Drastic pressure changes increase the likelihood of foaming. Additionally, increasing the propellant pressure also increases the amount of propellant that is able to dissolve in the beer. Beer with excess dissolved carbon dioxide or other gases tastes stale and is also more likely to foam. Thus, increasing propellant pressure is not an acceptable way to increase the volumetric flow rate.

SUMMARY OF THE INVENTION

The invention, which is defined by the claims set out at the end of this disclosure, is directed to a tap apparatus for dispensing pressurized beverages at a flow rate substantially higher than prior tap apparata without increasing the beverage supply pressure and without producing any significant foaming. The tap apparatus includes a dispenser head having an internal enclosure and a fluid conduit extending from a beverage source to the dispenser head. The fluid conduit enters the dispenser head and extends into the enclosure, and it opens onto the enclosure at a conduit exit. The enclosure of the dispenser head opens at a pouring aperture to allow beverage to exit the dispenser head. A full-port valve, that is, a valve which provides no constriction of the flow path when fully open, is situated within the fluid conduit between the beverage source and the dispenser head. Use of a full-port valve prevents the turbulence created by other types of valves common in prior art tap apparata and allows faster filling with less foaming. The fluid conduit preferably has substantially constant diameter between the beverage source and the dispenser head to reduce turbulence therebetween, and the fluid conduit preferably gradually expands adjacent the conduit exit to reduce the fluid flow velocity and gradually decrease the fluid pressure. Preferably, the flow area of the fluid conduit adjacent the conduit exit is greater than approximately two times the flow area of the fluid conduit at the valve exit.

In one preferred embodiment, the pouring aperture of the dispenser head faces downwardly when the dispenser head is in its operative position. The fluid conduit enters the dispenser head and protrudes into its enclosure so that the conduit exit faces generally upwardly when the dispenser head is in its operative position. Beverage flowing through the fluid conduit thus flows through the fluid conduit and into the enclosure of the dispenser head, upwardly through the fluid conduit and out the conduit exit, and then downwardly through the enclosure and out the pouring aperture. Because the fluid conduit within the dispenser head extends upwardly to terminate in an upward-facing conduit exit, the beverage must flow upwardly, and therefore much of its kinetic energy is converted to potential energy. This serves to further slow the velocity of the beverage within the diffusing (expanding) portion of the fluid conduit. Preferably, the upwardly-extending expanding portion of the fluid conduit is configured for the nominal beverage supply pressure so that the beverage will reach the conduit exit with drastically reduced velocity, spilling over the sides of the conduit exit rather than being ejected therefrom. Because the beverage spills from the conduit exit to leave the pouring aperture with a pouring action rather than being forcibly squirted from the conduit exit and pouring aperture, the dispensing head is said to act as a "bottomless pitcher."

It is then generally desirable to situate the conduit exit within the enclosure so that all elements of fluid flowing from the conduit exit have substantially the same effective flow path length when flowing from the conduit exit to the pouring aperture. This can be done, for example, by forming the enclosure of the dispenser head so that it surrounds the portion of the fluid conduit adjacent the conduit exit in a generally coaxial manner, and so that the conduit exit and pouring aperture are generally coaxial. If this arrangement is used, one of the following two operational arrangements is then recommended depending on the operating conditions under which the tap apparatus is to function (i.e., the flow rate desired, the nominal supply pressure, etc.):

First, the spacing between the fluid conduit within the enclosure and the walls of the dispenser head surrounding the enclosure can be carefully tailored so that the fluid flow area between the conduit exit to the pouring aperture is substantially constant. In this case, all diffusion occurs within the fluid conduit before the beverage reaches the conduit exit. Because the flow area remains substantially constant from the conduit exit to the pouring aperture, the beverage maintains substantially constant pressure and velocity as it flows through the enclosure and will only foam if an excessive pressure drop is experienced at the pouring aperture. Additionally, for a given enclosure volume, this arrangement minimizes the enclosure's surface area to volume ratio, thus minimizing nucleation sites on the enclosure walls whereupon foam formation can occur.

Second, the spacing within the enclosure between the fluid conduit and the walls of the dispenser head can be carefully tailored so that an expanding flow area is provided between the conduit exit and the pouring aperture, thereby causing further diffusion of the beverage after it leaves the conduit exit and before it leaves the pouring aperture. This may be desirable at high supply pressures or where very high flow rates are desired because this additional diffusion will further slow the beverage and drop its pressure.

The portion of the fluid conduit between the beverage source and the full-port valve is preferably flexible, as by forming this portion from elastomeric tubing. This flexibility allows the valve and dispenser head to be freely manipulated with respect to the beverage source so that the dispenser head can be readily moved over different pitchers, cups, or other beverage-receiving vessels.

Alternatively, the fluid conduit can be made rigid over the entirety of its length. In this case, the fluid conduit is preferably vertically oriented to terminate in an upwardly-facing conduit exit at the dispenser head. The dispenser head can include a pouring aperture situated above the fluid conduit and exiting the enclosure to allow beverage to escape therefrom. This pouring aperture is preferably oriented in a generally horizontal direction and is wholly or partially surrounded by a lip or spout from which the beverage may pour. The dispenser head thus acts as a sort of vertically oriented "bottomless pitcher" from which beverage is dispensed at extremely high flow rates without substantial foam. The vertical alignment of the fluid conduit is advantageous because it allows gravitational forces to work in further slowing the flow rate of beverage exiting the conduit exit. In this embodiment, it is also advantageous to include a hinged cap at the top of the dispenser head which may open to allow easier cleaning of the conduit exit and enclosure. This cap can include a gate or dam which descends into (or rides over) the surface of the beverage within the enclosure and skims off the foam prior to the beverage's escape from the pouring aperture.

Where the tap apparatus is to be designed for a particular application, e.g., where the nominal beverage supply pressure and the desired flow rate are known, it is desirable to have the diffusion in the fluid conduit be such that a stagnation point is created within the dispenser head (that is, so that the dynamic pressure of the beverage within the fluid conduit is fully converted to static pressure by the time the beverage exits the pouring aperture). The beverage thus falls or pours from the pouring aperture solely owing to gravity, rather than being ejected from the pouring aperture by virtue of its kinetic energy. Reducing or eliminating the kinetic energy of the dispensed beverage further reduces foam formation because the dispensed beverage will not be as greatly agitated as it strikes the walls of a receiving vessel, i.e., a cup or pitcher. Where the nominal beverage supply pressure is preset and invariable, a stagnation point within the dispenser head can be generated by creating the appropriate diffusion within the dispenser head. Where possible, a more versatile arrangement can be obtained by adding a suitable pressure regulator to the beverage supply, as by adding a valve and indicator dial to the pressure input hose leading to the beverage source, so that a user can modify the supply pressure such that a stagnation point is created within the dispenser head.

Because the tap apparatus dispenses beverages off of conventional beverage kegs at 2–4 times the speed of conventional tap apparata without any appreciable foam, it also tends to attract attention from beverage consumers as an object of curiosity. This attraction can be heightened by forming the dispenser head from transparent material to allow consumers to see the beverage flowing therein.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
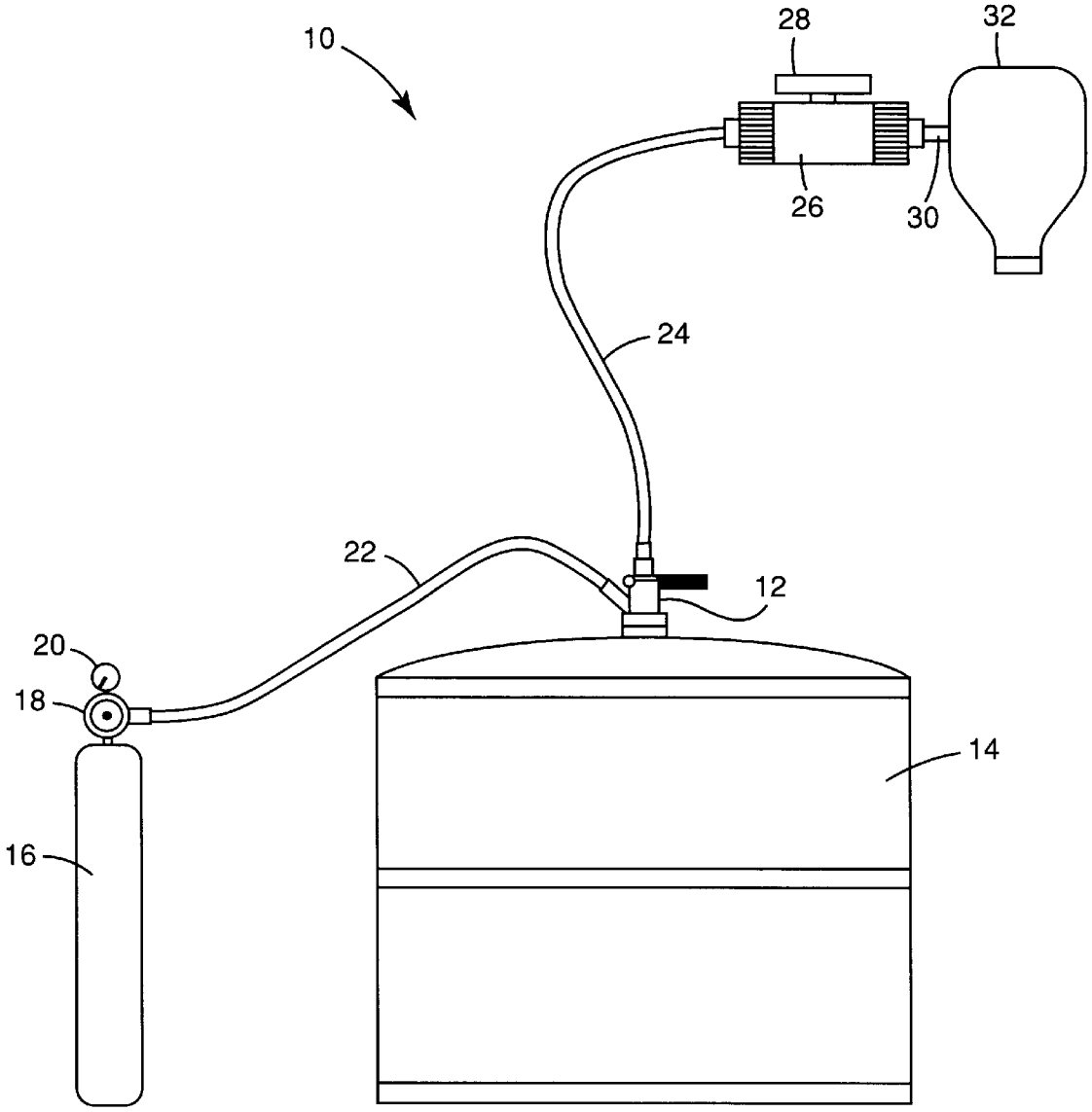
FIG. 1 is a side elevation view of a first embodiment of the beverage tap apparatus.

In the drawings, wherein the same or similar features of the invention are designated in all Figures with the same reference numerals, a first preferred embodiment of the tap apparatus is illustrated in FIG. 1 at the reference numeral 10. Several known elements which do not constitute a part of what is considered to be the invention are shown. A wide-bore tavern head 12 is attached to the standard fitting on top of a beverage keg 14. A pressurized carbon dioxide cylinder 16 may be used as a pressure source, though a hand-actuated pump or other pressure source may be used instead. A pressure regulator 18 along with a pressure gauge 20 is used to adjust the pressure of the propellant to its optimal setting. Flexible tubing 22 is used to attach the pressure source 16 to the tavern head 12.

Elements of the preferred embodiment are then shown in FIG. 1. Tubing 24, which is preferably flexible FDA-approved food and beverage tubing or stainless steel tubing, is connected to the tavern head 12. A full-port valve 26, that is, a valve which has constant diameter throughout the length of its flow passage when opened to a fully open state, is connected to tubing 24. Where the full-port valve 26 includes a rotatable spool having a flow orifice coaxially aligned with the flow passage of the valve when fully open, flow is adjusted from fully off to fully on by turning a valve knob 28. A fluid conduit 30, which preferably has the same flow passage diameter as the tubing 24 and the valve 26 for the major portion of its length, then connects the valve 26 to a dispenser head 32. The fluid conduit 30 is attached to the valve 26 via a barbed tube fitting 34 (FIG. 2), and is preferably rigid to allow a user holding the valve 26 to easily flex the tubing 24 to position the dispenser head 32 over a cup or pitcher during filling. Once placed under pressure, beverage from within the keg 14 is forced through tavern head 12 and conveyed through tubing 24 to the full-port valve 26.

Figure 2:
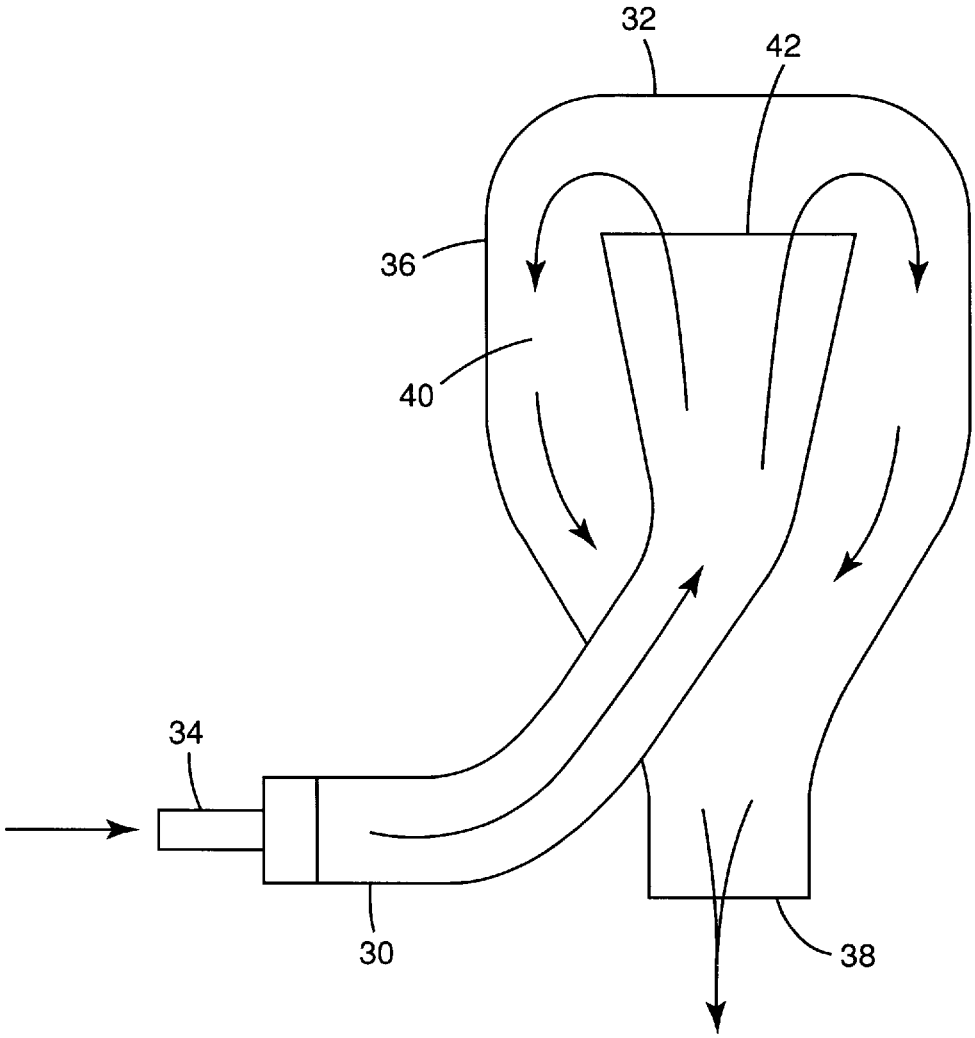
FIG. 2 is a schematic sectional view of the fluid conduit and dispenser head of the beverage tap apparatus of FIG. 1.

The dispenser head 32 is then illustrated in greater detail in FIG. 2. The dispenser head 32 includes a hood 36 which defines a pouring aperture 38 opening onto an internal enclosure 40, into which the fluid conduit 30 extends to terminate in an upwardly-facing conduit exit 42. FIG. 2 illustrates the dispenser head 32 in its normal operating position, with the conduit exit 42 oriented upwardly and the pouring aperture 38 directed downwardly. The size and configuration of the dispenser head 32 have a dramatic effect on its performance and thus merit detailed mention.

Preferably, the enclosure 40 is situated generally coaxially with respect to the fluid conduit 30 at the conduit exit 42, with the pouring aperture 38 situated along and centered about the axis of the fluid conduit 30 at the conduit exit 42. As can be seen from FIG. 2, this provides effectively the same flow path length for all elements of beverage between the conduit exit 42 and the pouring aperture 38 (except where the fluid conduit 30 enters the enclosure 40, thereby requiring that some fluid elements take a slightly longer flow path to flow around the conduit 30).

The fluid conduit 30 has generally the same flow passage diameter from the outlet of the valve 26 to the point where it enters the dispenser head 32. The fluid conduit 30 then expands within the enclosure 40 of the dispenser head 32 up to the point where it reaches the conduit exit 42. Preferably, this expansion is such that the diameter of the fluid conduit 30 at the conduit exit 42 is greater than two times the diameter of the fluid conduit 30 where it enters the dispenser head 32, and most preferably is approximately three times the diameter of the fluid conduit 30 where it enters the dispenser head 32. This expansion of the fluid conduit 30 decreases the flow rate of beverage therein by increasing the cross-sectional flow area, and it also gradually decreases the pressure of the beverage before exposing it to the atmosphere. The flow rate of the beverage is further decreased in the expanding portion of the fluid conduit 30 by orienting the conduit exit 42 upwardly, so that the kinetic energy of the beverage is converted to potential energy as the beverage approaches and exits the conduit exit 42 (i.e., velocity head is converted to pressure head). When the length of the expanding portion of the fluid conduit 30 (and the expansion therein) are properly chosen for the nominal supply pressure in question, this results in the beverage reaching the conduit exit 42 with little or no velocity, and the beverage therefore spills over the sides of the conduit exit 42 rather than being "ejected" therefrom. The beverage then spills over the sides of the conduit exit 42 to exit the pouring aperture 38, effectively simulating the action of pouring beverage from a pitcher into a cup. The dispenser head 32 thereby acts as a sort of "bottomless pitcher."

To better maintain the flow speed and pressure at the same state that it is in at the conduit exit 42, the hood 36 of the dispenser head 32 can be sized and configured so that the flow path between the conduit exit 42 and the pouring aperture 38 has substantially the same diameter throughout its length (preferably taking into account the effect on diameter that the fluid conduit 30 will have where it enters the dispenser head 32). This arrangement ensures that substantially all diffusion occurs within the fluid conduit 30, rather than in the dispenser head 32. Because the flow area of the flow path remains substantially constant from the conduit exit 42 to the pouring aperture 38, the beverage maintains substantially constant pressure and velocity throughout the enclosure 40. As a result, the beverage will only generate a non-negligible amount of foam if an excessive pressure drop is experienced at the pouring aperture 38. For a given enclosure 40 volume, this arrangement also minimizes surface area to volume ratio, thus minimizing nucleation sites and bubble formation on the walls of the hood 36 surrounding the enclosure 40 and on the sides of the fluid conduit 30 within the enclosure 40.

It is also possible to configure the dispenser head 32 so that the flow path between the conduit exit 42 and the pouring aperture 38 has a gradually enlarging diameter, thereby further diffusing the beverage passing therebetween. This arrangement may be particularly desirable where lesser diffusion occurs in the fluid conduit 30—e.g., where the diameter of the fluid conduit 30 at the conduit exit 42 is less than two times the diameter of the fluid conduit 30 where it enters the dispenser head 32—so that further diffusion can occur before the beverage exits the pouring aperture 38. It is notable that this arrangement can allow the use of dispenser heads 32 of lesser size, since the conduit exit 42 (and also the enclosure 40) may be reduced in size and suitable diffusion can still result.

It is also notable that careful selection of the amount of expansion within the dispenser head 32, the pressure drop within the valve 26, and the standard nominal pressure of the pressure regulator 18 can lead to further beneficial results. In particular, it is desirable to carefully tailor the expansion of the fluid conduit 30 so that the pressure of the beverage between the conduit exit 42 and the pouring aperture 38, when taking into account the standard nominal beverage supply pressure set by the pressure regulator 18 and the pressure drop within the valve 26, is set to define a stagnation point within the dispenser head 32. Thus, depending on the standard nominal beverage supply pressure to be set by the pressure regulator 18, the expansion within the fluid conduit 30 (and the enclosure 40, where flow area expansion occurs therein) is such that the dynamic pressure of the beverage is converted to static pressure, and so that beverage pours from pouring aperture 38 owing to gravity rather than owing to velocity head. To explain in other terms, beverage travels through the fluid conduit 30 at high speed (high kinetic energy), which is then converted to potential energy as the beverage flows upwardly out the diffusing conduit exit 42 and through the pouring aperture 38. The beverage then flows from the pouring aperture 38 solely or substantially owing to its potential energy, rather than kinetic energy; it falls from the pouring aperture 38, rather than "jetting" therefrom. This assists in preventing undue agitation of the beverage within the cup or other beverage-receiving vessel and thereby further decreases foaming. The selection and combination of a dispenser head 32 having the proper expansion with a valve 26 having the appropriate pressure drop in order to meet this condition is a matter of routine calculation and/or experimentation to one skilled in fluid mechanics once the standard nominal beverage supply pressure for the application at hand is known. (It is noted that ideally a full-port valve will have little or no pressure drop when fully open, so in many cases the pressure drop of valve 26 will be negligible.)

Figure 3:
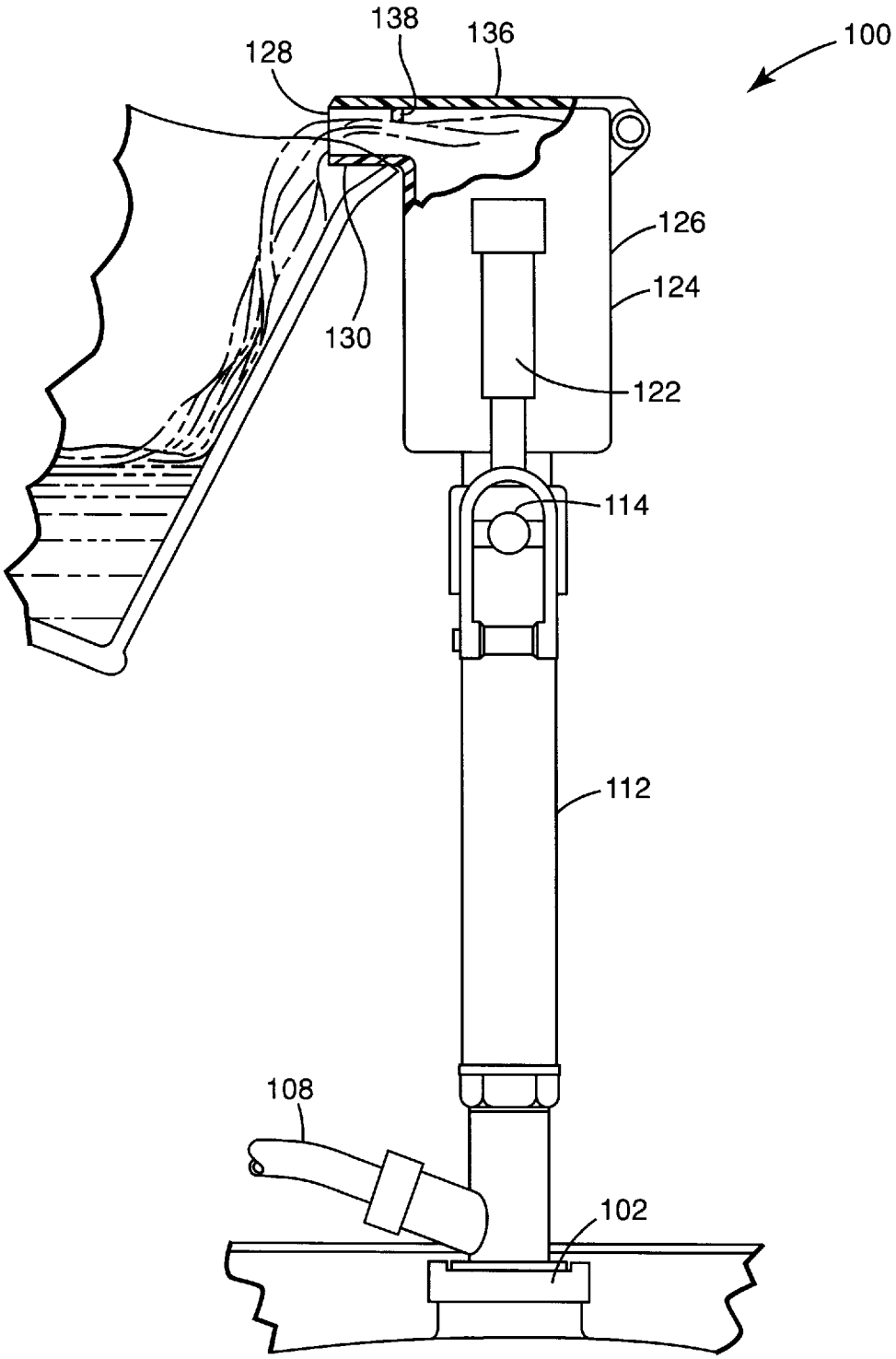
FIG. 3 is a side elevation view of a second embodiment of the beverage tap apparatus.
Figure 4:
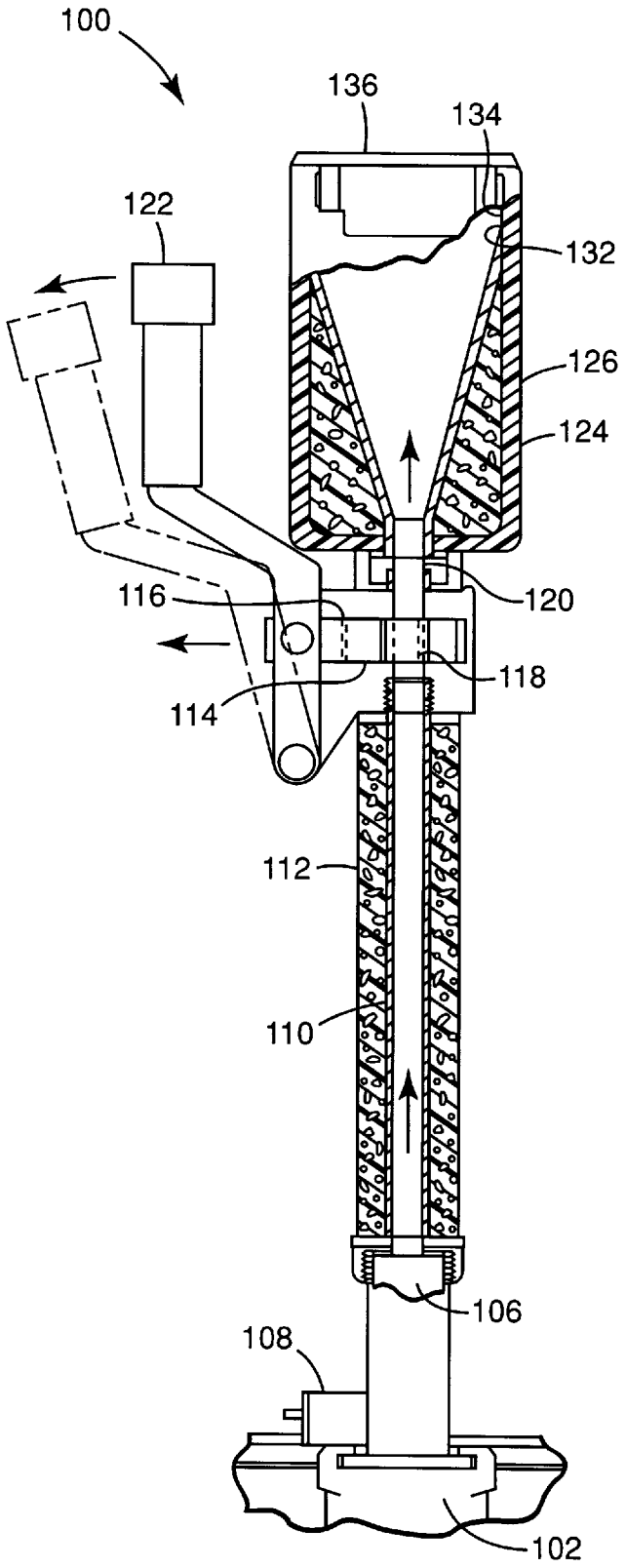
FIG. 4 is a rear elevation view of the beverage tap apparatus of FIG. 3.

An alternate embodiment of the tap apparatus is illustrated in FIGS. 3 and 4 at 100. This tap apparatus 100 utilizes a standard tavern head attachment 102 which fits atop a beverage keg 104 and provides a flow inlet 106 (FIG. 4) into which a pressure hose 108 is fitted. Vertically oriented tubing 110 (FIG. 4) leads from the flow inlet 106, and the tubing 110 is preferably surrounded by an insulated shell 112 to keep beverage flowing therein cool. A full port valve 114 is provided, in this case a spool valve wherein a spool 116 slides to align an orifice 118 coaxially with the flow passage of the tubing 110 and a flow conduit 120. A short throw of the slide valve handle 122 (preferably forty degrees or less) serves to open the valve 114. It is possible to throttle flow using this valve 114, but this can disturb the flow through the valve 114 and cause the beverage to foam. As with the tap apparatus 10, the fluid flow passage through the tubing 110 and the fully-open valve orifice 118 is substantially constant from the flow inlet 106 to the valve 114. The fluid conduit 120 then leads from the valve to a dispenser head 124. The dispenser head 124 preferably has a surrounding insulated hood 126 wherein the fluid conduit 120 expands in a vertical direction. Alternately, the hood 126 may exclude insulation and may be made of transparent material, such as an acrylic plastic, to attract the interest of viewers when beverage fills the hood 126. The hood 126 has a pouring aperture 128 (FIG. 3) defined along one side with the surrounding portion of the hood 126 defining a pouring spout 130. The fluid conduit 120 can be considered to have a conduit exit 132 (FIG. 4) at the point where it ceases to expand. The hood 126 may then include a nonexpanding enclosure portion 134 between the conduit exit 132 and the pouring aperture 128, though this is not necessary and the conduit exit 132 may be situated at the same height as the pouring aperture 128. The hood 126 preferably includes a hinged cap 136 (or a cap which is otherwise effectively removable) to allow easier cleaning of the conduit exit 132. The cap may include a downwardly-protruding gate 138 (FIG. 3) adjacent the pouring aperture 128 to skim away any foam that is produced prior to the beverage exiting the pouring aperture 128.

This tap apparatus 100 functions in effectively the same manner as the tap apparatus 10, except that a rigid flow path is provided and the pouring is effected generally horizontally, rather than vertically. The tap apparatus 100 more effectively converts dynamic pressure to static pressure by having beverage flow vertically upward against the force of gravity as it expands within the fluid conduit 120. Otherwise, the tap apparatus 100 utilizes several of the same principles as the tap apparatus 10: volumetric flow rate is increased by increasing the cross-sectional flow area instead of by increasing the beverage supply pressure, and foaming is reduced by reducing turbulence throughout the system by use of a substantially constant flow passage followed by gradual diffusion near the pouring point. Volumetric flow rate is proportional to the radius of the flow passage raised to the fourth power, so small increases in cross-sectional flow area throughout the entire length of the system result in a drastic increase in flow rate. In the tap apparata 10 and 100, a 0.375 inch diameter flow area is maintained throughout the length of the system, approximately double the diameter of most current systems. Maintaining a constant diameter flow path also reduces many of the bottlenecks found within many current systems, further reducing agitation of the beverage and the likelihood of excessive foaming.

In repeated tests, the tap apparatus 10 has been found to pour a standard pitcher full of beer in less than 15 seconds with virtually no foam. The use of spring-loaded valve or a two-position on/off valve is recommended because it allows the valve to be rapidly turned on and off. However, such a valve does have the disadvantage that it snap to the fully-open valve state so rapidly that no considerable amount of foam is generated while filling. Since a minimal amount of foam can enhance the attractiveness of a glass of beer, it could be desirable in some cases to utilize a valve which allows partial opening so that the beverage can be throttled to produce a desired amount of foam. Alternatively, baffles or other turbulence generators can be placed somewhere within the flow path, or the diffusion within the fluid conduit can be decreased so that a greater pressure drop occurs when the beverage reaches the atmosphere during pouring.

It is understood that preferred embodiments of the invention have been described above in order to illustrate how to make and use the invention. The invention is not intended to be limited to these embodiments, but rather is intended to be limited only by the claims set out below. Thus, the invention encompasses all alternate embodiments that fall literally or equivalently within the scope of these claims.

What is claimed is:

1. An apparatus for dispensing pressurized beverages comprising:

a. a dispenser head defining an enclosure having a pouring aperture, wherein the pouring aperture faces generally downwardly when the dispenser head is in its operative position;

b. a fluid conduit entering the enclosure of the dispenser head to terminate in a conduit exit, wherein the conduit exit faces generally upwardly when the dispenser head is in its operative position, whereby pressurized beverage flowing through the fluid conduit when the dispenser head is in its operative position has a fluid flow path directed upwardly through the fluid conduit, out the conduit exit, and then downwardly through the enclosure and out the pouring aperture.

2. The apparatus of claim 1 wherein the fluid conduit increases in flow area as the conduit exit is approached.

3. The apparatus of claim 1 wherein the flow area of the fluid conduit adjacent the conduit exit is greater than approximately two times the flow area of the fluid conduit outside the enclosure of the dispenser head.

4. The apparatus of claim 2 wherein the flow area of the fluid flow path from the conduit exit to the pouring aperture is substantially constant.

5. The apparatus of claim 2 wherein the flow area of the fluid flow path enlarges from the conduit exit to the pouring aperture.

6. The apparatus of claim 1 wherein the pouring aperture is situated along an axis of a portion of the fluid conduit adjacent the conduit exit.

7. The apparatus of claim 1 wherein the enclosure of the dispenser head is generally coaxial with respect to a portion of the fluid conduit adjacent the conduit exit.

8. The apparatus of claim 6 wherein the portion of the fluid conduit adjacent the conduit exit increases in flow area as the conduit exit is approached.

9. The apparatus of claim 1 further comprising a full-port valve connected to the fluid conduit.

10. The apparatus of claim 9 wherein the flow area of the fluid conduit is substantially constant between the full-port valve and the enclosure of the dispenser head.

11. The apparatus of claim 9 further comprising a beverage source connected to the fluid conduit, the full-port valve being interposed between the beverage source and the dispenser head, wherein the portion of the fluid conduit extending between the full-port valve and the dispenser head is flexible.

12. The apparatus of claim 1 further comprising a pressure regulator in operative connection with the fluid conduit, the pressure regulator being adapted to adjust the pressure of a fluid within the fluid conduit so as to generate a stagnation point within the enclosure of the dispenser head.

13. An apparatus for dispensing beverages comprising:

a. a fluid conduit terminating in a conduit exit, the conduit exit being oriented upwardly when the apparatus is in an operative position;

b. a dispenser head defining an enclosure surrounding the conduit exit, the dispenser head having a pouring aperture opening onto the enclosure;

c. a pressure regulator in operative connection with the fluid conduit to regulate the pressure of fluid therein, wherein the pressure regulator creates a fluid stagnation point within the enclosure, thereby inducing beverage flowing within the fluid conduit and enclosure to pour from the pouring aperture solely due to gravity.

14. The apparatus of claim 1 wherein the flow area of the fluid conduit enlarges adjacent the conduit exit.

15. The apparatus of claim 14 wherein the flow area of the fluid conduit enlarges by a factor of at least two.

16. The apparatus of claim 13 wherein the pouring aperture faces downwardly when the apparatus is in an operative position.

17. The apparatus of claim 13 wherein the flow area of the fluid flow path from the conduit exit to the pouring aperture is substantially constant.

18. The apparatus of claim 13 wherein the flow area of the fluid flow path enlarges from the conduit exit to the pouring aperture.

19. The apparatus of claim 13 further comprising a full-port valve connected to the fluid conduit.

20. The apparatus of claim 19 wherein the flow area of the fluid conduit is substantially constant between the full-port valve and the enclosure of the dispenser head.

21. The apparatus of claim 19 further comprising a beverage source connected to the fluid conduit, the full-port valve being interposed between the beverage source and the dispenser head, wherein the portion of the fluid conduit extending between the full-port valve and the dispenser head is flexible.

22. An apparatus for dispensing beverages comprising:

a. a beverage source;

b. a dispenser head defining an enclosure and a pouring aperture opening onto the enclosure;

c. a fluid conduit extending from the beverage source to the dispenser head, the fluid conduit entering the dispenser head and terminating in a conduit exit which opens onto the enclosure, the conduit exit being oriented generally upwardly when the dispenser head is in an operative position;

d. a full-port valve in the fluid conduit between the beverage source and the dispenser head, wherein the pressure in the fluid conduit is regulated to provide a stagnation point within the enclosure, thereby causing beverage flowing within the fluid conduit and enclosure to flow from the pouring aperture due to gravity.

* * * * *